United States Patent [19]

Nenoff

[11] Patent Number: 4,930,769

[45] Date of Patent: Jun. 5, 1990

[54] UNIFIED PULL-PUSH EXERCISE DEVICE

[76] Inventor: Joseph R. Nenoff, 1451 Wyoming Ave., Niagara Falls, N.Y. 14305

[21] Appl. No.: 149,383

[22] Filed: Jan. 28, 1988

Related U.S. Application Data

[63] Continuation of Ser. No. 939,063, Dec. 8, 1986, abandoned.

[51] Int. Cl.[5] ..... A63B 21/00

[52] U.S. Cl. ..... 272/120; 272/144

[58] Field of Search ..... 272/72, 144, 134, 126, 272/143, 900, 120, 121

[56] References Cited

U.S. PATENT DOCUMENTS

| | | | |
|---|---|---|---|
| 1,982,843 | 12/1934 | Traver | 272/72 |
| 2,682,402 | 6/1954 | McCarthy | 272/134 |
| 2,783,045 | 2/1957 | Bosch | 272/144 X |
| 3,572,701 | 3/1971 | Agamian | 272/79 |
| 3,622,154 | 4/1971 | Williams | 272/120 |
| 3,892,404 | 7/1975 | Martucci | 272/144 |
| 4,004,801 | 1/1977 | Campanaro | 272/120 |
| 4,101,124 | 7/1978 | Mahnke | 272/144 X |

FOREIGN PATENT DOCUMENTS

| | | | |
|---|---|---|---|
| 2356437 | 4/1978 | France | 272/134 |

*Primary Examiner*—Richard J. Apley
*Assistant Examiner*—H. Flaxman
*Attorney, Agent, or Firm*—Wallace F. Neyerlin

[57] ABSTRACT

The unified pull-push exercise device consists of a slanted beam which can be positioned at various angles from the horizontal. The beam as an attached movable seat that travels the length of the beam. A stationary gripping handle or bar is positioned above the beam and is spaced at a strategic distance from the top of the beam. The position of the gripping handle is also carefully calculated above the top of the beam, and away from the user's shoulders so that a full range of motion is realized.

8 Claims, 3 Drawing Sheets

UNIFIED PULL-PUSH EXERCISE DEVICE

The present application is a continuation of application Ser. No. 939,063, filed Dec. 8, 1986, now abandoned.

The present invention relates to an improved exercise device and more particularly to a slanted board exercise device wherein the user exerts muscle effort against the weight of his own body.

A number of portable slant board exercise devices have previously been proposed. The majority of such devices are quite bulky and complicated in both assembly and use. The generally large size and weight of such prior art devices make them portable only with great difficulty. Of necessity such prior art devices must be folded, or disassembled, to be moved. The majority of the prior art slant board devices require ropes or cords which must be adjusted either to the stature or to the arm, or leg length, of the user. The ropes or cords used on such devices are subject to wear due to pulling, usually around pulleys, and to constant tensing and untensing. Such lines require regular replacement as a sudden breakage of a line can result in serious injury to the exerciser. Frequently such devices also require weights or springs to supply resistance or counter force to the exerciser. Typical examples of prior art slant board devices are: U.S. Pat. Nos. 3,892,404; 4,101,124 and 4,241,915.

The present device is portable, compact, and requires no ropes or cords, needs no permanent installation, or complicated assembly for use. The present device requires no weights, free or otherwise, nor does it require pulleys or springs to supply resistant force to the user. The weight of the exerciser supplies the entire resistance or counter force. The present device needs no adjustment or adaptation to the user and may be utilized with ease by persons of all sizes, ages and weights.

Physical exercise activities, in general, may be categorized into protagonistic and antagonistic activities. In protagonistic activity the exerciser exerts a pulling effort, for example, in performing the exercise called "pullups" the exerciser exerts a pulling force to raise himself from an extended, usually vertical, position below a support means until a portion of his body, usually his chest or neck, is even with or slightly above the support means. In antagonistic activity the exerciser exerts a pushing force, for example, in performing the exercise called "dips" the exerciser exerts a resistive force to lower himself from an extended, usually vertical, position above a support means until a portion of his body, usually his chest or waist, is even with the support means. The present device provides a means of doing either protagonistic exercises, such as, pullups, or antagonistic exercises, such as, dips, or combinations thereof, with less than his entire body weight. Most uniquely the present device allows the user to select the protagonistic and antagonistic exercise or combinations thereof over a substantially broad range, while at the same time allowing the individual to tailor his exercise effort to his particular need or desire.

BRIEF DESCRIPTION OF THE INVENTION

The present device consists of an angled, or slanted, beam positioned at an angle of from about 10 to about 50 degrees, and more preferably, from about 20 to about 35 degrees, from the horizontal. The beam is angularly positioned between a base member and a substantially vertical elongated support member. The beam has a moveably attached seat mounted thereon having a path of travel substantially the entire length of the beam. A stationary gripping means is securedly positioned above the beam member and is spaced a sufficient distance from the top of the beam that a person may lay along the beam member, below the gripping means, and with elbows flexed grasp the gripping means. In a particularly preferred embodiment the gripping means is positioned from about 20 to about 26 inches above the top surface of the beam and the gripping surfaces on the gripping means are positioned to be about even, or slightly inward from, the users shoulders, generally ranging from about 18 to about 24 inches apart.

In using the device the exerciser positions himself with his back on the beam placing his buttocks or lower back in contact with the moveable seat. Assuming that the exerciser starts with the seat at the lower portion of the beam, he may do pullups by reaching to grasp the stationary gripping means and pulling his body upward, passing under the gripping means, until his neck or chin is even with the gripping means. Optionally he may then proceed past the normal pullup ending position, changing from a protagonistic to an antagonistic exercise, with substantially no transition, to push himself further upward until his waist or the lower portion of his body is even with the gripping means. From such upper position the exerciser may then lower himself until the gripping means is even with his chin or neck, or until his arms are extended upward as in the orginal starting position. Thus, the exerciser may selectively execise by choosing the range and intensity of exercise and to exercise specific upper body muscles as he chooses and to the extent that he chooses.

DETAILED DESCRIPTION OF THE INVENTION

The invention will now be described in detail by reference to the accompanying drawings in which similar components are identified by similar numbers in each of the views.

Figure 1:
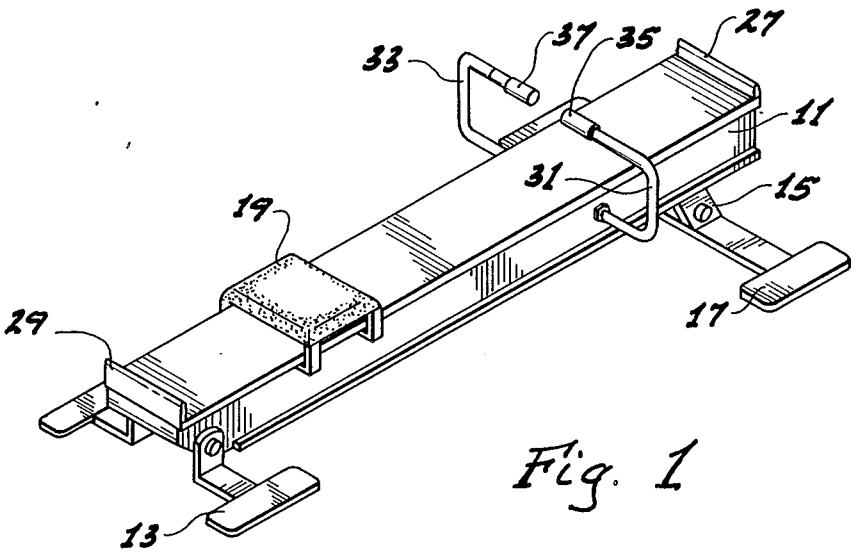
FIG. 1 is a perspective view of the basic exercise device of the present invention.

Looking now at FIG. 1, angled, or slanted, beam member 11, which may be a solid beam, or as shown in the drawings, an I-beam suitably fabricated of a light metal such as aluminum, is positioned at an angle of between about 10 and about 50, and more preferably from about 20 and about 35 degrees, from the horizontal. Although the present device, or various components thereof, may aptly be fabricated of plastic or wood, the device is preferably fabricated of a light metal, such as, aluminum, in order to facilitate portability and the use of the device in a wide variety of environments, e.g., outdoors, or in high humidity areas such a steam rooms. Slanted beam 11 has lower base member 13 positioned at the bottom lower end thereof extending outward from either side to aid in stabilizing the device. An extended support member, such as leg, 15, is positioned along the upper portion of beam 11, contiguous to the end thereof, to maintain beam 11 in a slanted position. Support member 15 has a stabilizing means such as outwardly extending base member 17 positioned along the lower portion thereof.

Figure 3:
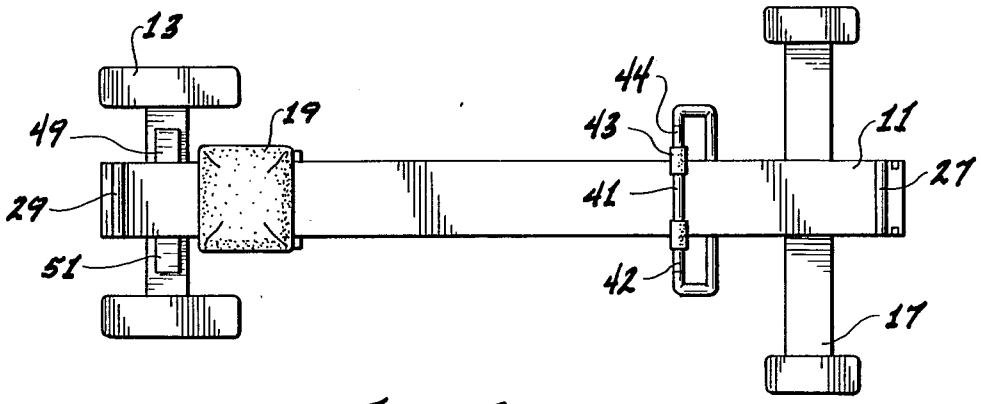
FIG. 3 is a top elevational view of the device illustrating a modification of the gripping means and and the utilization of optional foot supports.

Slanted beam 11 has a moveable seat 19 mounted thereon. Moveable seat 19 may be suitably padded on the top portion. The path of travel of moveable seat 19 extends substantially the length of beam 11. Seat 19 is preferably moveably attached to beam 11 by extentions, such as, 21 and 23 and is moveable along beam 11, suitably on roller or bearing means, such as, 25. Stops 27 and 29 are positioned at the ends of beam 11 to prevent seat 19 from moving beyond the ends thereof. A stable, rigid, gripping means, for example, stationary handle bar members 31 and 33 extend outward from either side of beam 11. The gripping means is rigidly fixed above beam 11. Handle bar members 31 and 33 may be adjustable in height above beam 11, or may be permanently positioned at a set height over beam 11. The stable gripping means, such as, handle bar members 31 and 33, is positioned along the upper portion of beam 11, preferably in the upper one-third, and is spacedly positioned over beam 11 at a sufficient distance to allow the exerciser to lay along said beam, below the gripping means, and grasp the gripping means, such as, separate grips, or handles, 35 and 37 with his elbows flexed. Preferably the gripping means is spaced from about 20 to 26 inches from the top of beam 11 and the separate grips are preferably spaced from about 18 to about 24 inches apart, that is, the space, or span, between the end of the grips that distance. As shown in FIG. 3, the gripping means may comprise a single, continuous bar, such as 41, extending entirely across beam 11. Preferably grips or handles, such as, 35 and 37, are rotatably mounted on handle bar members 31 and 33.

In use, the exerciser places a portion of the back of his body, for example, his buttocks or lower back, on seat 19, and laying face up with his back along the beam grasps the gripping means, such as, handles 35 and 37. The exerciser may grasp the gripping means either with his fingers positioned either toward or away from his body. The exerciser while maintaining his back slightly out of contact with the beam, with his weight on seat 19, may then pull himself upward, as one would do a pullup, until his body reaches the end point of a normal pullup, and then, optionally moving his body upward, continue using a pushing force until he reaches an uppermost position where the gripping means is even with the lower part of his body, for example, his waist or at a point where his arms are fully extended downward. This movement involves both pulling (protagonistic exercise) and pushing (antagonistic exercise) on the part of the exerciser, with substantially no transition. In lowering himself from such uppermost position the exerciser essentially does an elongated downward dip. The lowering movement involves the use of various and different muscles and combinations of muscles as he passes himself downward from the upper to the lower position. The present exercise device provides a means of carrying out various combinations of such elongated, extended exercises at selected intensities, or using a single arm. Thus, the user can position himself at various selected positions along beam 11 and practice a specific, desired exercise or exercise selected muscles.

It is to be noted that the hands of the exerciser grasping the grip means do not move relative to the body of the exerciser.

Figure 2:
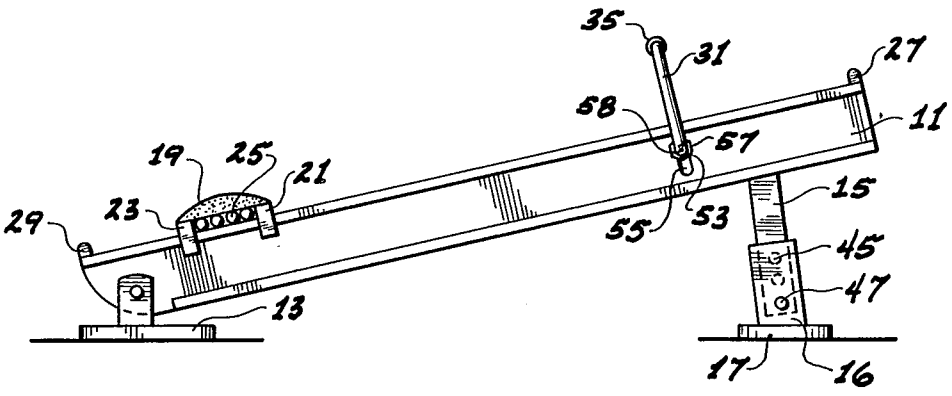
FIG. 2 is a front elevational view of the device shown in FIG. 1 and further illustrates a means of adjusting the angle of incline of the beam, and in addition a means of adjusting the height of the gripping means above the beam.

FIG. 2 is a front elevational view of the device shown in FIG. 1. FIG. 2 also illustrates an adjusting means for varying the angle that beam 11 can be positioned from the horizontal by varying the length of support member 15. The adjusting means may be in the form of an adjusting screw or crank to raise and lower beam 11, or as shown in FIG. 2, an extention, or overlap, 16, of extended support member 15 having alignment holes 45 adapted to receive a pin, such as, 47 to secure beam 11 at various angles. FIG. 2 also illustrates an adjustment for varying the height of the stable gripping means over beam 11. The gripping means may be positioned higher (further from the exerciser) or lower (closer to the exerciser). When positioned further away from the user, raising and lowering of ones body is more difficult and sufficiently more lower arm and wrist exertion is required. When positioned closer to the user raising and lowering ones body is easier, but more upper arm and shoulder exertion is required. As shown in FIG. 2 the gripping means, such as, handles 35 and 37, may suitably be adjusted in height over beam 11 by moving the lower portion of the gripping means, 53, within slot 55 in beam 11 and securing the gripping means in the desired location by a securing means, such as nut 57 and threaded connection 58.

FIG. 3 illustrates an alternative embodiment wherein the gripping means consists of a continuous bar, 41, crossing above beam 11. In such embodiment bar 41 suitably has a tubular grip, such as 43, rotatably mounted thereon. Areas designated as hand grip locations for the exerciser may be denoted by markings, such as, 42 and 44. FIG. 3 also illustrates an alternative embodiment wherein foot supports 49 and 51, suitably extentions from the lower portion of beam 11, are provided to enable the exerciser to utilize leg strength to move, or help move, his body up and down beam 11. In this mode the device may also be utilized to perform static, isometric, or isotonic contraction, exercises by the user bracing his feet against supports 49 and 51 and using his leg strength to exert an upward force while at the same time holding hand gripping means and using the muscles in his upper body to exert a counteracting downward force.

While the present invention has been described and illustrated in detail, various modifications may be made by those skilled in the art. It is therefore to be understood that the invention is not to be limited to the details of construction described and illustrated and it is intended by the appended claims to cover all modifications which fall within the spirit and scope of the invention.

What is claimed is:

1. An improved portable exercise device capable of providing unified pullpush exercise for the user thereof and consisting essentially of:

(a) a single angled beam member having a flat top surface, an upper end and a lower end;

(b) a stationary outwardly extending base member positioned along said lower end of said beam member;

(c) an elongated adjustable support member positioned contiguous to said upper end of said beam member which controls the angle of the beam member; said beam member being angularly positioned at an angle of between about 10 and about 50 degrees between said base member and said elongated support member;

(d) a seat member moveably attached to and independently moveable over substantially the entire length of said flat top surface of said beam member; and (e) A rigid, stationary gripping means securedly affixed to the sides of said beam member, said stationary gripping means being maintained in a rigidly fixed, spaced position above the upper half of said beam member, said gripping means being positioned a sufficient distance above said beam member to allow a person to position himself longitudinally along said beam member atop said seat member and below said gripping means, and while so positioned grasp said gripping means and while maintaining his hands in a substantially stationary position on said gripping means, move his body along substantially the entire length of said beam member changing between a protagonistic and an antagonistic exercise with substantially no transition therebetween.

2. The exercise device of claim 1 wherein the gripping means is positioned from about 20 to about 26 inches above the top surface of the beam.

3. The exercise device of claim 1 wherein the said gripping means are handles.

4. The exercise device of claim 1 wherein the said gripping means is a continuous bar.

5. The exercise device of claim 1 wherein the angle of said angled beam is adjustable.

6. The exercise device of claim 1 wherein the height of gripping means over said angled beam is adjustable.

7. The exercise device of claim 1 wherein foot supports are positioned along the lower end of said beam.

8. The exercise device of claim 1 wherein said gripping means are in the form of grips and said grips are spaced from about 18 to about 24 inches apart.

* * * * *